United States Patent [19]

Karita et al.

[11] Patent Number: 5,051,759

[45] Date of Patent: Sep. 24, 1991

[54] INK JET CARTRIDGE AND INK TANK

[75] Inventors: Seiichiro Karita; Masami Ikeda, both of Tokyo, Japan

[73] Assignee: Canon Kabushiki Kaisha, Tokyo, Japan

[21] Appl. No.: 463,311

[22] Filed: Jan. 10, 1990

[30] Foreign Application Priority Data

Jan. 13, 1989 [JP] Japan ..... 1-7408

[51] Int. Cl.[5] ..... B41J 2/175

[52] U.S. Cl. ..... 346/140 R

[58] Field of Search ..... 346/140 PD, 140 R; 73/304 R; 101/364, 366

[56] References Cited

U.S. PATENT DOCUMENTS

| | | | |
|---|---|---|---|
| 4,095,237 | 6/1978 | Amberntsson et al. | 346/140 |
| 4,306,245 | 12/1981 | Kasugayama et al. | 346/140 |
| 4,313,124 | 1/1982 | Hara | 346/140 |
| 4,345,262 | 8/1982 | Shirato et al. | 346/140 |
| 4,368,478 | 1/1983 | Koto | 346/140 |
| 4,459,600 | 7/1984 | Sato et al. | 346/140 |
| 4,463,359 | 7/1984 | Ayata et al. | 346/1.1 |
| 4,558,333 | 12/1985 | Sugitani et al. | 346/140 |
| 4,723,129 | 2/1988 | Endo et al. | 346/1.1 |
| 4,740,796 | 4/1988 | Endo et al. | 346/1.1 |
| 4,771,295 | 9/1988 | Baker et al. | 346/1.1 |
| 4,782,754 | 11/1988 | Pohlig | 101/364 |

FOREIGN PATENT DOCUMENTS

| | | |
|---|---|---|
| 59-123670 | 7/1984 | Japan . |
| 59-138461 | 8/1984 | Japan . |

*Primary Examiner*—Benjamin R. Fuller
*Assistant Examiner*—Alrick Bobb
*Attorney, Agent, or Firm*—Fitzpatrick, Cella, Harper & Scinto

[57] ABSTRACT

An ink jet cartridge for ink jet printer has an ink jet unit having discharge ports for discharging an ink, an ink tank formed integrally with the ink jet unit and accommodating an ink absorption member which is impregnated with the ink to be discharged from the discharge ports, and electrodes held in contact with or inserted into the ink absorption member for the purpose of detecting the quantity of the ink remaining in the ink tank.

28 Claims, 8 Drawing Sheets

INK JET CARTRIDGE AND INK TANK

BACKGROUND OF THE INVENTION (1) Field of the Invention

The present invention broadly relates to a liquid jet recording apparatus for recording data by means of a jet of a recording liquid (referred to also as "ink" hereinafter). More particularly, the invention relates to an ink tank for use in an ink jet recording apparatus and also to an ink jet recording head (referred to also as an "ink jet cartridge" hereinafter) having the ink tank integral therewith. Still more particularly, the present invention is concerned with an ink tank and an ink jet cartridge having improved means for detecting the quantity of ink remaining in the ink tank.

(2) Related Background Art

FIGS. 1 and 2 schematically illustrate two types of ink jet recording heads of the background art. Each of these liquid jet recording heads has an ink tank for storing a recording ink and a recording head tip (referred to also as an "ink jet unit" hereinafter) provided with an energy generating means for energizing the ink to be discharged from discharge ports in the tip so as to record data on a sheet of recording paper.

More specifically, referring to FIG. 1, an ink jet recording apparatus has a recording head tip, i.e., an ink jet unit, denoted by 1. The apparatus also has an ink tank 2 and a detector 3 for detecting the quantity of the ink remaining in the ink tank 2. The detector 3 has a pressure chamber 5 communicating with an ink supply passage 4, a diaphragm 6 for isolating the pressure chamber 5 from the atmosphere, and a switch 7 which is turned on and off in response to a deflection of the diaphragm 6. During the operation of the recording apparatus, the ink in the ink tank 2 is gradually consumed as a result of repeated jetting of the ink for the purpose of recording and also for the purpose of purging of any clogging port in the discharge port. In consequence, a negative pressure is generated in the pressure chamber 5 and the diaphragm 6 is deflected by the negative pressure so as to turn the switch 7 on, thereby emitting an electric signal 8 indicating that the ink tank 2 is becoming empty.

On the other hand, the liquid jet recording head shown in FIG. 2 has a flexible cable 9 connected to the recording head tip 1 and capable of supplying electrical signals thereto, and a pair of detection electrodes 10A and 10B disposed in the ink passage 4. In this case, the electrical resistance between these detection electrodes 10A and 10B is changed in accordance with a change in the quantity of the ink remaining in the ink tank, so that the quantity of the ink remaining in the ink tank is detected through detection of the resistance between the electrodes 10A and 10B.

The background art of FIG. 1, however, cannot precisely indicate the quantity of the ink remaining in the ink tank, because the change in the pressure within the pressure chamber 5 fluctuates due to fluctuation of precision of the parts which form the pressure chamber 5. In addition, the detector tends to erroneously produce an "empty" signal due to an impacting change in the pressure which takes place as a result of the purging. Furthermore, quite troublesome work is required for the installation of the detector, particularly when the ink tank is integrated with the liquid jet recording head tip.

The background art recording head of FIG. 2 also is disadvantageous in that the detection is often impeded due to presence of air bubbles in the ink. Namely, if air bubbles conveyed through the ink supply passage stagnate around the electrodes 10A and 10B, no electrical current flows between the electrodes so that the detector generate an "empty" signal even when a large quantity of ink remains in the ink tank.

SUMMARY OF THE INVENTION

Accordingly, an object of the present invention is to provide a recording liquid tank and a liquid jet recording head having such a tank, which are capable of accurately detecting the quantity of a recording liquid remaining in the tank without fail, thereby overcoming the above-described problems of the background art.

To this end, according to the present invention, there is provided an ink jet cartridge comprising an ink jet unit having a discharge port for discharging an ink tank integral with the ink jet unit and accommodating an ink absorption member which is impregnated with the ink to be discharged from the discharge port and at least one electrode held in pressure contact with or inserted into the ink absorption member for the purpose of detecting the quantity of the ink remaining in the ink tank.

According to another aspect of the invention, there is provided an ink tank comprising an ink absorption member disposed inside the tank and impregnated with the ink to be discharged from the discharge ports and at least one electrode held in pressure contact with or inserted into the ink absorption member for the purpose of detecting the quantity of the ink remaining in the ink tank.

According to still another aspect of the invention, there is provided an ink jet recording apparatus comprising an ink jet cartridge of the type mentioned above, and a member for mounting the ink jet cartridge.

According to the invention, it is possible to detect, with a high degree of reliability, the quantity of the recording ink remaining in the tank, despite inclusion of air bubbles in the recording ink and any impacting change in the pressure which takes place when purging is conducted for the purpose of recovery of a clogged discharge port.

These and other objects, features and advantages of the present invention will become clear from the following description of the preferred embodiments when the same is read in conjunction with the accompanying drawings.

DESCRIPTION OF THE PREFERRED EMBODIMENTS

Figure 1:
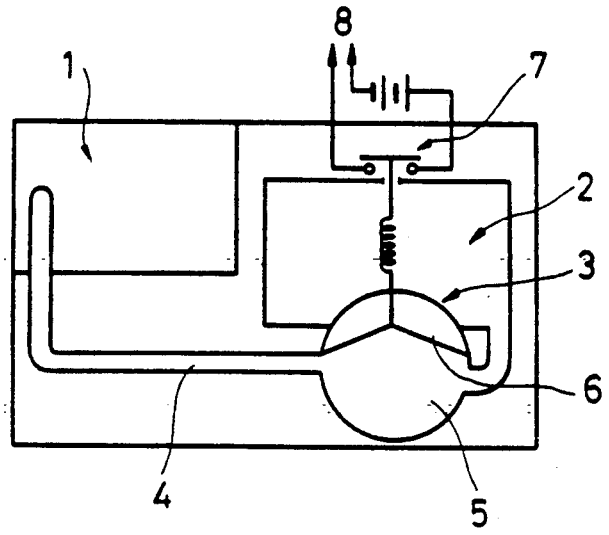
FIG. 1 PRIOR ART
FIGS. 1 and 2 are schematic illustrations of two different types of background art arrangements for detecting the quantity of a recording liquid remaining in a recording liquid tank.
Figure 2:
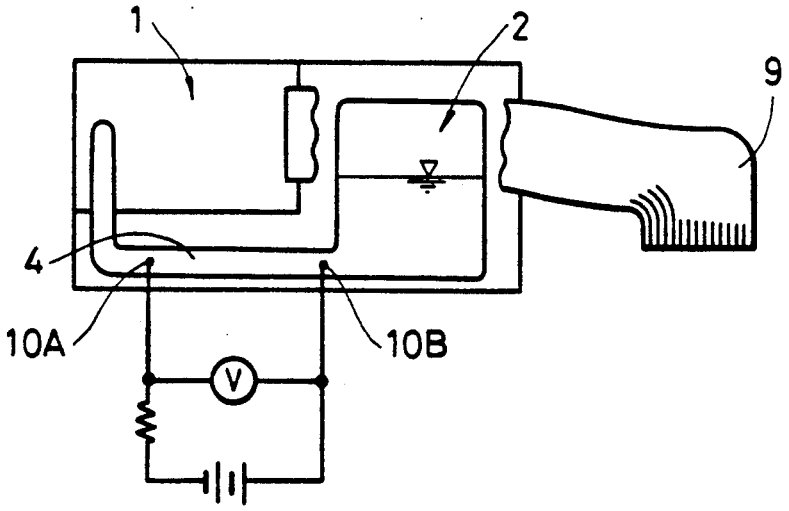
FIG. 2 PRIOR ART

The invention will be more fully understood from the following description of preferred embodiments taken in conjunction with the drawings.

FIGS. 3A and 3B show an embodiment of an ink jet recording head of the present invention which is designed and constructed as a disposable cartridge having an ink tank as a source of supply of a recording ink and a recording head tip integral with the ink tank.

The recording head tip, which is denoted by 100, has a discharge portion 102, a reservoir portion 104 and so forth. The discharge portion 102 has a plurality of discharge ports 102A opening in the surface of the discharge portion 102 opposing a recording medium (not shown), ink channels inward from the discharge ports 102A, discharge energy generating elements such as electro-thermal conversion elements disposed in the respective ink channels, and a common ink chamber with which all of the ink channels communicate. The ink channels and the common ink chamber will be collectively referred to as an ink passage.

The reservoir portion 104 is supplied with an ink from an ink tank 110 and delivers it to the common ink chamber in the discharge portion 102, thus functioning as a subtank.

Numeral 112 denotes an ink absorption member which is made of a porous material or fibers and which is disposed in the ink tank 110 and impregnated with the ink. The ink tank 110 is capped with a cap 114. A pair of pin-shaped electrodes 120A and 120B for detecting the quantity of ink remaining in the ink tank 110 have their ends inserted into the ink absorption member 112 in the ink tank 110. The electrodes will be referred to also as "detection pins", hereinafter.

Figure 3:
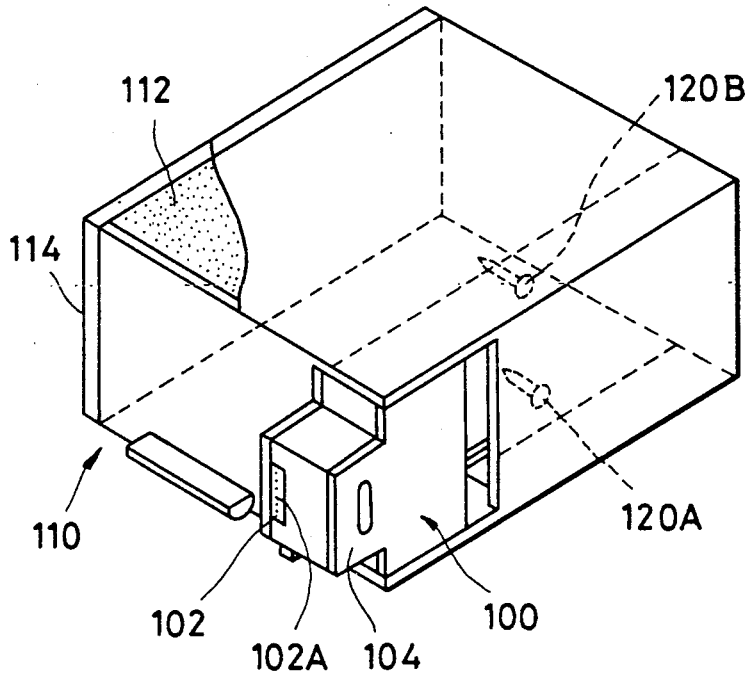
FIGS. 3A and 3B are a perspective view and a sectional view of an embodiment of the present invention in the form of a disposable cartridge.
Figure 3:
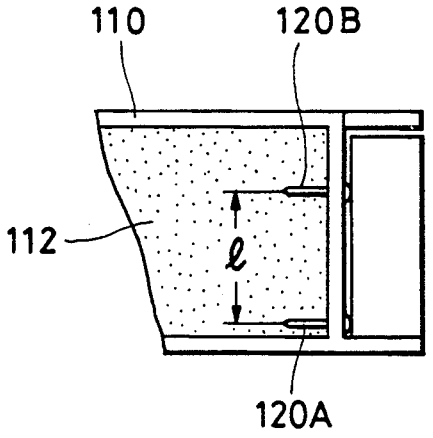
Figure 4:
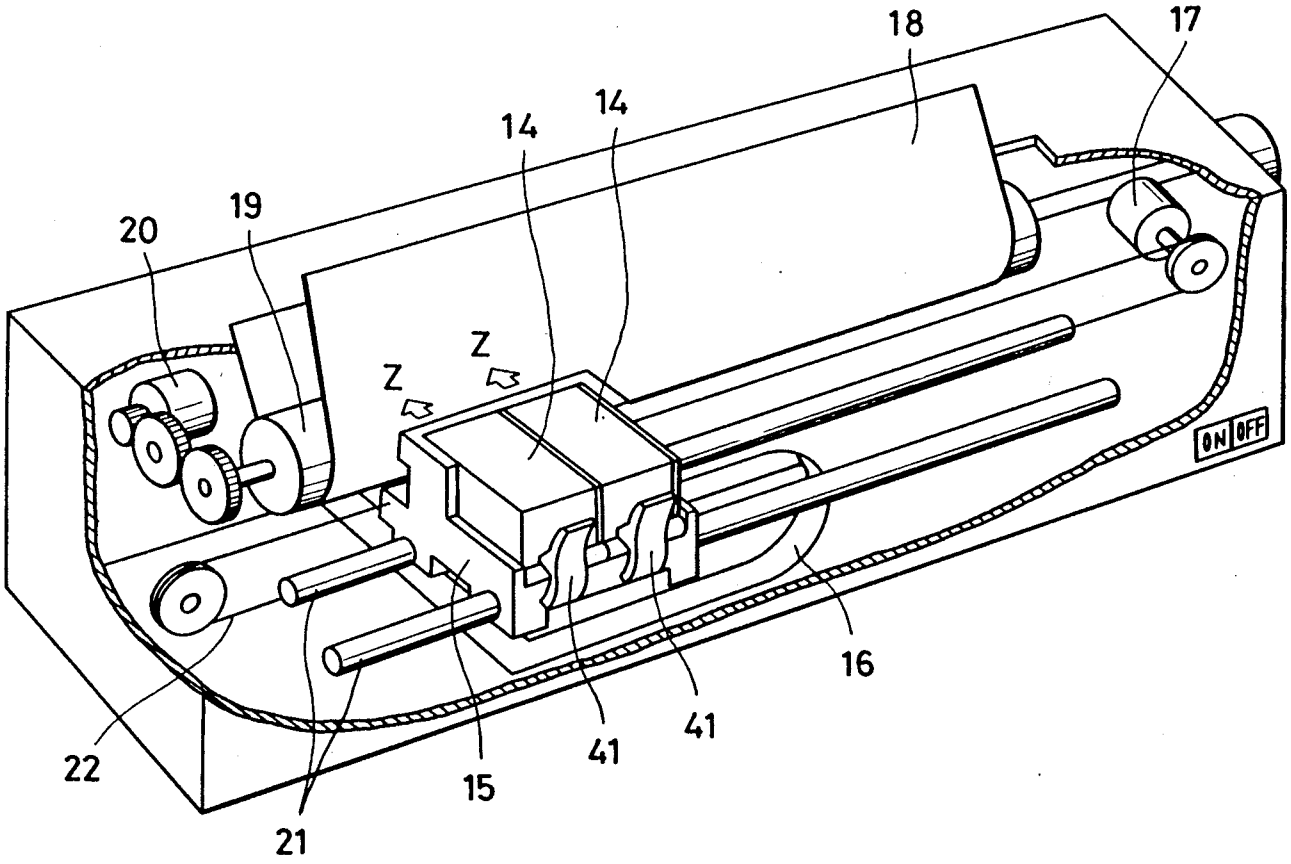
FIG. 4 is a perspective view of an ink jet recording apparatus incorporating the recording head shown in FIG. 3.

FIG. 4 illustrates an ink jet printer incorporating the disposable cartridge type ink jet recording head shown in FIGS. 3A and 3B.

Referring to FIG. 4, the disposable cartridge type ink jet recording head is generally denoted by 14. The recording head 14 is fixed onto a carriage 15 by means of a retainer member 41. The carriage 15, recording head 14 and the retainer 41 are movable as a unit reciprocatingly along a shaft 21. The recording head 14 can be precisely located on the carriage 15 through mutual engagement between locating holes formed in the recording head tip 100 and locating pins provided on the carriage 15. The electrical connection between the recording head and the stationary side of the printer is accomplished by coupling a connector on the carriage to a connector pad of a circuit board (not shown) which carries wires leading to the discharge portion 102 and the detection pins 120A, 120B.

The ink discharged from the recording head flies and reaches the recording surface of a recording medium 18 which is backed up by a platen 19, so as to form an image on the recording medium 18.

A suitable data source delivers, through a cable 16 and terminals connected to the cable 16, discharge signals corresponding to the image of the data to be printed. When the printing is conducted in a single color, the printer usually has only one cartridge 14. The printer, however, may carry two or more cartridges 14 corresponding to the number of printing colors.

A carriage motor 17 delivers, through a wire 22, output power to the carriage 15 so as to cause the carriage 15 to run along the shaft 21. A feed motor 20 is drivingly connected to a platen roller 19 so as to rotate the platen thereby feeding the recording medium 18.

In the ink jet recording head of the present invention, as described hereinbefore, the detection pins 120A, 120B serving as detection electrodes have their ends received in the ink tank, unlike the background art arrangements in which detection electrodes are disposed in the ink passage. According to the invention, therefore, it is possible to precisely detect the quantity of the ink remaining in the ink tank without being disturbed by air bubbles trapped in the ink and without being affected by an impacting change in pressure caused by purging.

A discussion will be made hereinafter on the distance l between the detection electrodes.

Figure 5:
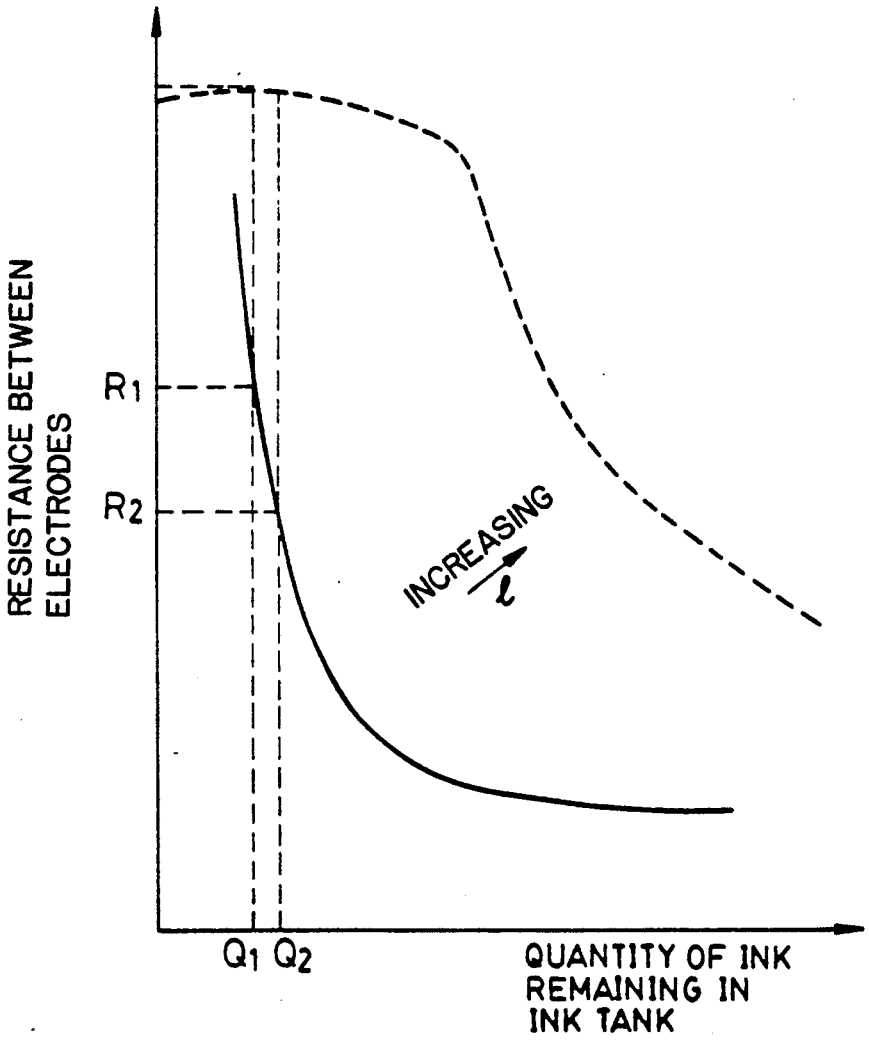
FIG. 5 is a graph showing the relationship between the quantity of the ink remaining in an ink tank and electrical resistance between a pair of electrodes.

FIG. 5 is a graph showing the relationship between the electrical resistance between the electrodes, i.e., the detection pins 120A, 120B, and the quantity of ink remaining in the ink tank. A solid-line curve shows the electrical resistance in relation to the ink quantity as observed when the distance l between the detection electrodes is considerably small, whereas, when the distance l is large, the electrical resistance varies in a manner shown by a broken-line curve. Thus, the curve gradually shifts as indicated by an arrow in FIG. 5 as the distance l increases.

The distance l should be determined in accordance with various factors such as the construction of the ink tank 110, composition of the ink and so forth. An experiment showed that the distance l preferably ranges between 5 and 30 mm, and more preferably between 10 and 20 mm. When the distance l is too large, the electrical resistance curve fluctuates, as shown by broken lines, in a region where the quantity of the ink remaining in the tank is small. On the other hand, when the distance l is too small, detection is rendered difficult in the region where the quantity is small but is still practically sufficient for the operation of the printer. In the experiment, the electrical resistance generally ranged from less than a hundred to several hundred kiloohms (kΩ).

In FIG. 5, $Q_1$ represents the quantity of the ink remaining in the ink tank when printing has become imperfect or impossible due to a shortage of the ink, while $R_1$ represents the electrical resistance as measured when the printing is made imperfect or impossible. It is advisable that the detector is so set that it produces an "empty" signal when the electrical resistance has been increased to $R_2$ which is smaller than $R_1$ mentioned above, thus informing the user of the shortage of the ink well in advance of complete drying up of the ink tank, so that the remaining portion of the data to be printed, e.g, remaining characters in the line or page being printed, may be printed out. In this case, the ink is still available in an amount represented by $Q_2$–$Q_1$, even after the generation of the "empty" signal.

The detection pins 120A, 120B should have resistance to corrosion because they are used in contact with ink which is generally corrosive. Thus, the detection pins 120A, 120B are made of a corrosion-resistant material such as SUS or platinum or, alternatively, made from a suitable conductive material and plated with, for example, gold.

Figure 6A:
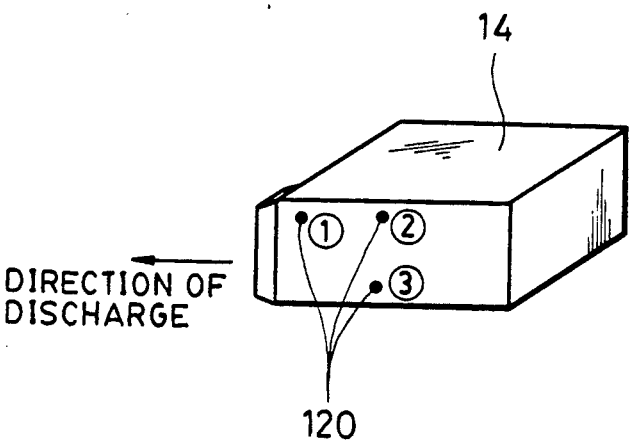
FIGS. 6A and 6B are schematic illustrations of a modification of the embodiment shown in FIGS. 3A and 3B.
Figure 6B:
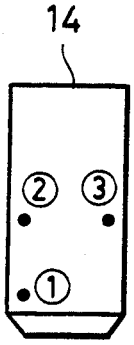
Figure 7:
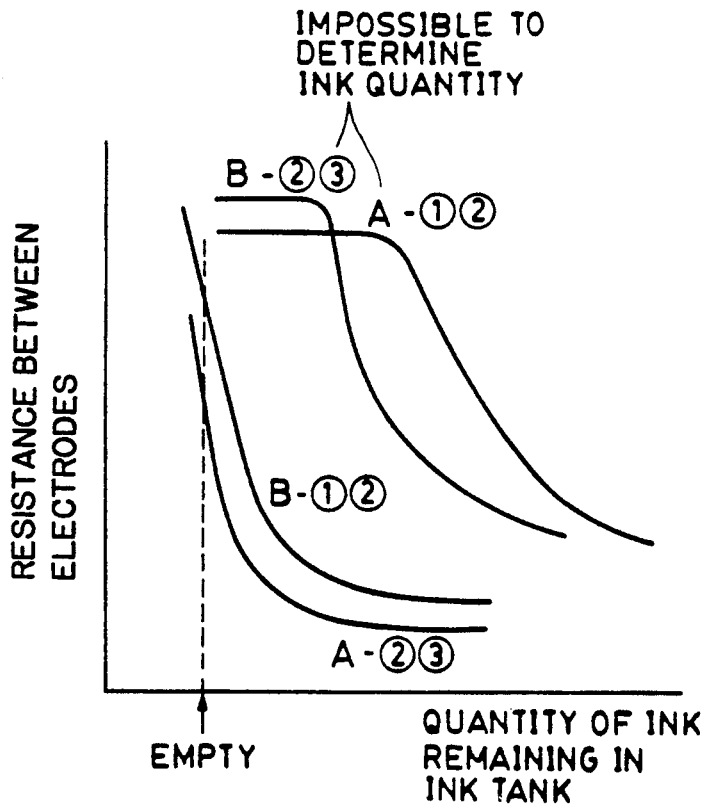
FIG. 7 is a graph showing the relationship between the quantity of the ink remaining in the ink tank and the electrical resistance between a pair of electrodes, explanatory of the manner in which the modification of FIGS. 6A and 6B are used.

The embodiment shown in FIGS. 3A and 3B employs a pair of detection pins. This, however, is not exclusive and three or more detection pins may be arranged as shown in FIGS. 6A and 6B to cope with a design demand in regard to the orientation of the ink tank 110 and the recording head 14. Namely, the use of a pair of detection pins alone may deteriorate the detecting precision as shown in FIG. 7 which shows curves representing a resistance-to-ink quantity characteristic. For instance, a curve "A-①②" represents the electrical resistance between the electrodes ① and ② arranged in a manner shown in FIG. 6.

Figure 8A:
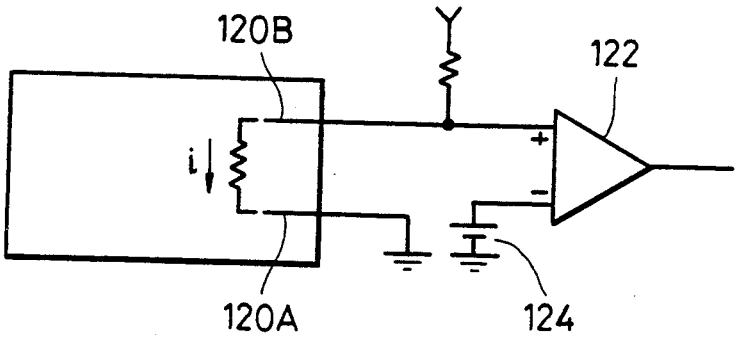
FIGS. 8A and 8B are circuit diagrams showing a detection circuit in different polarities.
Figure 8B:
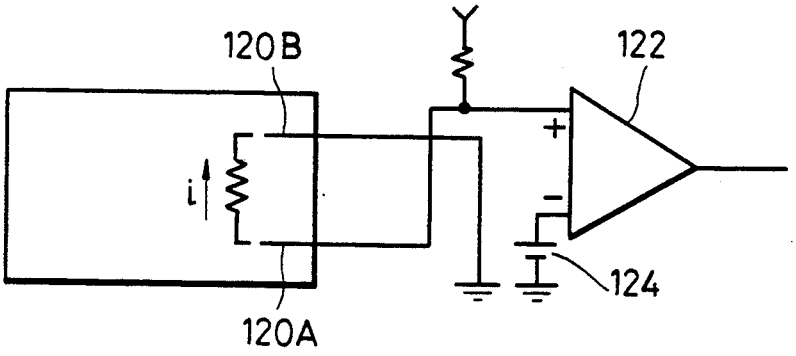

FIGS. 8A and 8B show an electric circuit for processing the signal from the electrodes 120A, 120B of FIG. 3 so as to produce the "empty" signal. The circuit has a comparator 122 and a reference voltage generator 124. The voltage representing the electrical resistance between the electrodes 120A, 120B is input to one of the input terminals of the comparator 122 so as to be compared with a reference voltage which is generated by the reference voltage generator 124 and applied to the other input terminal. An electrolysis of the ink inevitably takes place when the electrical current is supplied to the ink for measuring the resistance. In order to minimize the influence of this inconvenience, it is possible to trigger the measuring current at a suitable interval such that the current is supplied only for a short time of several milliseconds each time. It is also possible to alternately - the polarity of the voltage, i.e., the direction of measuring current, as shown in FIGS. 8A and 8B.

Figure 9:
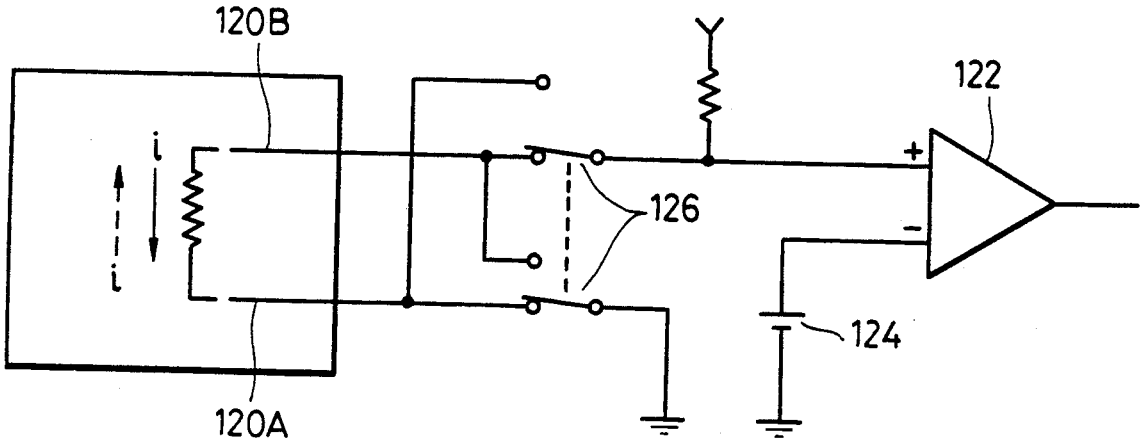
FIG. 9 is a circuit diagram of a circuit which effects the switching of the circuits between the states shown in FIGS. 8A and 8B.

FIG. 9 shows a circuit which is used for - . the switching of polarity of the circuit shown in FIG. 8A, 8B, i.e., the switching between the state shown in FIG. 8A and the state shown in FIG. 8B. This circuit has a relay switch 126 which is connected so as to be able to invert the polarity of the voltage applied between the electrodes 120A and 120B, so that the circuit is switched between the state shown in FIG. 8A and the state shown in FIG. 8B.

Each of the embodiments described hereinbefore employs a plurality of detection pins having an equal length that are inserted into the absorption member 122. This, however, is not exclusive and the invention can be carried out in various different manners as follows.

Figure 10:
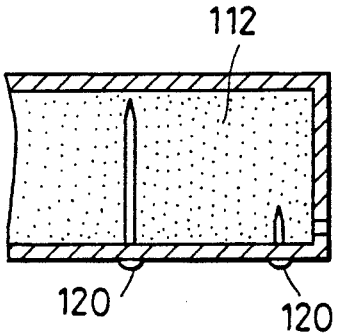
FIGS. 10A to 10D are schematic illustrations of different embodiments of the present invention.
Figure 10:
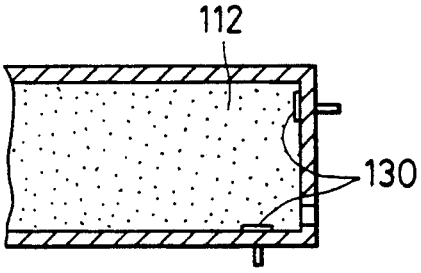
Figure 10:
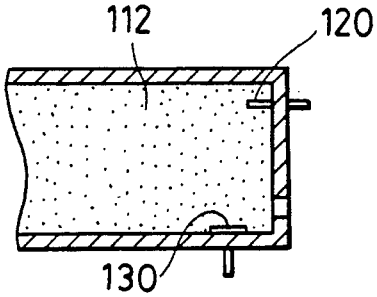
Figure 10:
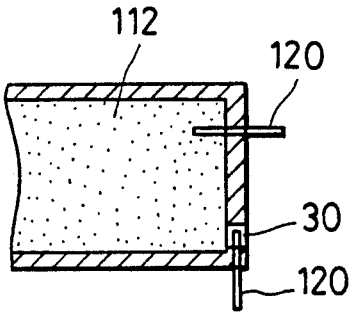

FIG. 10A shows an arrangement in which a pair of detection pins 120 of different lengths are inserted into the absorption member 112. FIG. 10B shows an arrangement in which each detection pin has an electrode plate 130 which has a tabular portion for pressing the ink absorption member 112. FIG. 10C shows an arrangement in which one of the detection pins is provided with an electrode plate 130. In an arrangement shown in FIG. 10D, one of the detection pins 120 is disposed in the ink passage, more specifically, in an ink outlet 30.

In the embodiments described hereinbefore, the recording head tip and the ink tank are integrated so as to form a disposable head cartridge. This, however, is only illustrative and the ink tank may be constructed as a member separate from the recording head chip, and the recording head tip need not always be disposable. The ink tank also may be arranged at any desired portion of the apparatus. Furthermore, the ink tank may be of the type which is not disposable but used repeatedly with additional supply of the ink by, for example, pouring.

Furthermore, the ink tank and the ink jet cartridge of the invention can be applied to printers of so-called full-multi or full-line type which have ink discharge ports arrayed over the entire length of the recording line, although the described embodiments are applied to so-called serial type printers in which the recording head moves along the recording medium to scan the same.

As has been described, according to the present invention, it is possible to detect the quantity of the recording ink remaining in the ink tank with a high degree of reliability without being affected by the inclusion of bubbles or any impacting change in the pressure caused by a purging of a clogged port, by virtue of the detection electrodes which are inserted into or pressed onto an ink absorption member disposed in the ink tank and impregnated with the ink.

In order to obtain a high degree of reliability of detection and to facilitate fabrication and handling, the invention is preferably carried out in the form of the embodiment shown in FIGS. 3A and 3B in which electrodes of substantially the same length are inserted into the ink absorption member.

The energy generation element for generating energy necessary for jetting the ink may be an electric/heat conversion element having a heat-generating resistor and electrodes connected to the resistor, or an electrical/mechanical conversion element such as a piezoelectric element.

The ink jet head to which the invention is applied may be designed such that ink is discharged from the discharge port in the same direction as the direction in which the ink is supplied to the portion of the ink passage where the energy generating element is disposed or may be discharged in a direction which is different from, e.g., orthogonal to, the direction of supply of the ink.

The present invention brings about excellent effects particularly when used in a recording head or recording device of bubble jet type among various ink jet recording systems.

As to its representative construction and principle, for example, one practiced by use of the basic principle disclosed in, for example, U.S. Pat. Nos. 4,723,129 and 4,740,796 is preferred. This system is applicable to either of the so-called on-demand type and continuous type. Particularly, the case of the on-demand type is effective because, by applying at least one driving signal which gives rapid temperature elevation exceeding nucleate boiling corresponding to the recording information on an electrical/heat conversion element arranged corresponding to the sheets of liquid passages holding the liquid (ink), heat energy is generated at the electrical/heat conversion elements to effect film boiling at the heat acting surface of the recording head, and consequently the bubbles within the liquid (ink) can be formed correspondingly one by one to the driving signals. By discharging the liquid (ink) through the discharge port by growth and contraction of the bubble, at least one droplet is formed. By making the driving signal into pulses, growth and contraction of the bubble can be effected instantly and adequately to accomplish more preferable discharging of the liquid (ink) particularly excellent in response characteristic. As the driving signals in the form of pulses, those as disclosed in U.S. Patent No. 4,313,124 of the invention concerning the temperature elevation rate of the above-mentioned heat acting surface.

As the construction of the recording head, in addition to the combinations of the discharge ports or orifices, liquid channels and electrical/heat conversion elements (linear or right angle liquid channel) as disclosed in the above-mentioned respective specifications, the construction use of U.S. Pat. Nos. 4,558,333 and 4,459,600 disclosing the construction having the heat acting portion arranged in the flexed region is also included in the present invention. In addition, the present invention can also be effectively carried out with the construction disclosed in Japanese Patent Laid-Open Publication No. 59-123670 which discloses the construction using a slit common to a plurality of electrical/heat conversion elements as the discharging portion or Japanese Patent Laid-Open Publication No. 59-138461 which discloses the construction having the opening for absorbing pressure waves of heat energy corresponding to the discharging portion.

Further, as the recording head of the full line type having a length corresponding to the maximum width of the recording medium which can be recorded by the recording device, either the construction which satisfies its length by combination of a plurality of recording heads as disclosed in the above-mentioned specifications or the construction as one recording head integrally formed may be used, and the present invention can exhibit the effects as described above further effectively.

In addition, the present invention is effective for a recording head of the freely exchangeable tip type which enables electrical connection to the main device or supply of ink from the main device by being mounted on the main device, or for the case by use of a recording head of the cartridge-type provided integrally on the recording head itself.

Also, addition of a restoration means for the recording head, a preliminary auxiliary means, etc. provided as the construction of the recording device of the present invention is preferable, because the effect of the present invention can be further stabilized. Specific examples of these may include, for the recording head, capping means, cleaning means, pressurization or aspiration means, electrical/heat conversion elements or other heating elements or preliminary heating means according to a combination of these, and it is also effective for performing stable recording to perform a preliminary mode which performs discharging separate from recording.

Further, as the recording mode of the recording device, the present invention is extremely effective for not only the recording mode using a primary stream color such as black etc., but also a device equipped with at least one of plural different colors or full color by color mixing, whether the recording head is integrally constructed or constructed in the form of a combination of a plurality of recording head units.

What is claimed is:

1. An ink jet cartridge comprising:

an ink jet unit having a discharge port for discharging ink;

an ink tank integral with said ink jet unit and accommodating an ink absorption member which is disposed to be impregnated with ink for discharge from said discharge port; and at least one electrode in contact with said ink absorption member for detecting the quantity of ink remaining in said ink tank.

2. An ink jet unit according to claim 1, wherein said electrode is in the form of a pin and is inserted into said ink absorption member.

3. An ink jet cartridge according to claim 1, wherein said electrode has a tabular portion which is held in pressure contact with said ink absorption member.

4. An ink jet cartridge according to claim 1, wherein a plurality of said electrodes are provided and spaced from one another at a distance ranging between 5 mm and 30 mm.

5. An ink jet cartridge according to claim 1, wherein a plurality of said electrodes are provided and spaced from one another at a distance ranging between 10 mm and 20 mm.

6. An ink jet cartridge according to claim 1, wherein said ink absorption member is a porous member.

7. An ink jet cartridge according to claim 1, wherein said ink absorption member is made of fibers.

8. An ink jet cartridge according to claim 1, further comprising an energy generating element disposed in an ink channel leading to the discharge port of said ink jet unit and capable of generating energy for discharging ink from said discharge port.

9. An ink jet cartridge according to claim 8, wherein said energy generating element includes a heat-generating resistor and element electrodes connected to said heat-generating resistor for generating heat energy.

10. An ink jet cartridge according to claim 8, wherein said energy generating element is an electro-mechanical conversion element having a piezoelectric element.

11. An ink jet cartridge according to claim 8, wherein ink is discharged from said discharge port in a direction which is substantially the same as the direction in which ink is supplied to the portion of said ink channel where said energy generating element is disposed.

12. An ink jet cartridge according to claim 8, wherein ink is discharged from said discharge port in a direction which is different from the direction in which said ink is supplied to the portion of said ink channel where said supplied to the portion of said ink channel where said energy generating element is disposed.

13. An ink jet cartridge according to claim 12, wherein ink is discharged from said discharge port in a direction which is substantially orthogonal to the direction in which ink is supplied to the portion of said ink channel where said energy generating element is disposed.

14. An ink jet cartridge according to claim 1, wherein said ink jet unit is of the full-line type having a plurality of said discharge ports which are arrayed to cover the width of a recording medium.

15. An ink jet cartridge according to claim 1, wherein said electrode is in pressure contact with said ink absorption member.

16. An ink jet cartridge according to claim 1, wherein said electrode is inserted into said ink absorption member.

17. An ink tank comprising:

an ink absorption member disposed inside said tank to be impregnated with ink for discharge from discharge ports of an ink jet head; and at least one electrode in contact with said ink absorption member for detecting the quantity of ink remaining in said ink tank.

18. An ink tank according to claim 17, wherein said electrode is in the form of a pin and is inserted into said ink absorption member.

19. An ink tank according to claim 17, wherein said electrode has a tabular portion which is held in pressure contact with said ink absorption member.

20. An ink tank according to claim 17, wherein a plurality of said electrodes are provided and spaced from one another at a distance ranging between 5 mm and 30 mm.

21. An ink tank according to claim 17, wherein a plurality of said electrodes are provided and spaced from one another at a distance ranging between 10 mm and 20 mm.

22. An ink tank according to claim 17, wherein said ink absorption member is a porous member.

23. An ink tank according to claim 17, wherein said ink absorption member is made of fibers.

24. An ink tank according to claim 17, wherein said electrode is in pressure contact with said ink absorption member.

25. An ink tank according to claim 17, wherein said electrode is inserted into said ink absorption member.

26. An ink jet recording apparatus comprising an ink jet cartridge and a member for mounting said ink jet cartridge, said ink jet cartridge comprising:

an ink jet unit having a discharge port for discharging ink;

an ink tank integral with said ink jet unit and accommodating an ink absorption member which is disposed to be impregnated with ink for discharge from said discharge port; and at least one electrode in contact with said ink absorption member for detecting the quantity of ink remaining in said ink tank.

27. An ink jet recording apparatus according to claim 26, wherein said electrode is in pressure contact with said ink absorption member.

28. An ink jet recording apparatus according to claim 26, wherein said electrode is inserted into said ink absorption member.

* * * * *

UNITED STATES PATENT AND TRADEMARK OFFICE

CERTIFICATE OF CORRECTION

PATENT NO. : 5,051,759

DATED : September 24, 1991

INVENTOR(S) : SEIICHIRO KARITA, ET AL.

It is certified that error appears in the above-identified patent and that said Letters Patent is hereby corrected as shown below:

On the title page:

IN [75] INVENTORS

"Seiichiro Karita; Masami Ikeda, both of Tokyo, Japan" should read --Seiichiro Karita, Yokohama; Masami Ikeda, Tokyo, both of Japan--.

IN [57] ABSTRACT line 1, "for ink" should read --for an ink--.
line 2, "an ink" should read --ink--.

COLUMN 1

Line 40, "port" (first occurrence) should be deleted.

COLUMN 2

Line 7, "generate" should read --may generate--.
Line 19, "an ink" should read --ink, an ink--.

COLUMN 5

Line 36, "alternately -" should read --alternately change--.
Line 37, "of measuring" should read --of the measuring--.
Line 39, "for -." should read --for effecting--.
Line 40, "FIG. 8A," should read --FIGS. 8A,--.

UNITED STATES PATENT AND TRADEMARK OFFICE

CERTIFICATE OF CORRECTION

PATENT NO. : 5,051,759

DATED : September 24, 1991

INVENTOR(S) : SEIICHIRO KARITA, ET AL.

It is certified that error appears in the above-identified patent and that said Letters Patent is hereby corrected as shown below:

COLUMN 7

Line 3, "Patent No. 4,313,124" should read --Patent Nos. 4,463,359 and 4,345,262 are suitably used. Further, excellent recording can be performed by employment of the condition described in U.S. Patent No. 4,313,124--.

COLUMN 8

Line 6, "ink jet unit" should read --ink jet cartridge--.
Line 44, "said" should be deleted.
Line 46, line 46 should be deleted.

Signed and Sealed this

Sixth Day of April, 1993

*Attest:*

*Attesting Officer*

STEPHEN G. KUNIN

*Acting Commissioner of Patents and Trademarks*